US006159342A

United States Patent [19]

Gustavsson et al.

[11] Patent Number: 6,159,342

[45] **Date of Patent: *Dec. 12, 2000**

[54] SHOE PRESS

[75] Inventors: Lars Gustavsson, Karlstad; Erik Brox, Forshaga, both of Sweden

[73] Assignee: Valmet-Karlstad AB, Sweden

[ * ] Notice: This patent is subject to a terminal disclaimer.

[21] Appl. No.: 09/163,766

[22] Filed: Sep. 30, 1998

Related U.S. Application Data

[60] Provisional application No. 60/069,907, Dec. 17, 1997, and provisional application No. 60/069,897, Dec. 17, 1997.

[30] Foreign Application Priority Data

Sep. 30, 1997 [SE] Sweden ..... 9703571

[51] Int. Cl.[7] ..... D21F 3/08

[52] U.S. Cl. ..... 162/358.3; 100/153; 162/361

[58] Field of Search ..... 162/358.3, 358.4, 162/358.5, 361; 100/153; 492/7

[56] References Cited

U.S. PATENT DOCUMENTS 4,713,147 12/1987 Saarinen ..... 162/358.3
5,620,566 4/1997 Holopainen ..... 162/358.3

FOREIGN PATENT DOCUMENTS 0 345 501 12/1989 European Pat. Off. .
4409316C1 6/1995 Germany .
19515832C1 5/1996 Germany .

*Primary Examiner*—Karen M. Hastings
*Attorney, Agent, or Firm*—Alston & Bird LLP

[57] ABSTRACT

A shoe press for a paper or board machine, comprising a press shoe and a counter roll, which between themselves form an extended nip for a paper or cardboard web and a circulated flexible belt, and a plurality of hydraulic loading cylinders which are arranged between a horizontal beam included in the frame system of the shoe press and the press shoe and adapted to press the press shoe against the counter roll, the pistons of the loading cylinders being fixedly connected to the horizontal beam. The working chambers of the loading cylinders are supplied with fluid by a common duct formed in an elongate duct member which is affixed to the beam. A vertical duct is formed in the piston of each loading cylinder and is connected to the common duct. The duct member is releasably affixed to the beam by eccentric clamping members which are fixable in multiple positions on the beam for selectively placing different portions of the clamping members in engagement with grooves formed in opposite sides of the duct member, such that the duct member and loading cylinders can be shifted as a unit in the machine direction of the shoe press.

10 Claims, 2 Drawing Sheets

SHOE PRESS

CROSS-REFERENCE TO RELATED APPLICATION

This application claims priority to U.S. Provisional Patent Application Serial No. 60/069,907, filed Dec. 17, 1997, and also claims priority to U.S. Provisional Patent Application Serial No. 60/069,897, filed Dec. 17, 1997.

FIELD OF THE INVENTION

The present invention relates to a shoe press for a paper or board machine, of the type having a press shoe for pressing a running fibrous web against a counter roll and a plurality of loading cylinders for urging the press shoe toward the counter roll.

BACKGROUND OF THE INVENTION

Various types of shoe presses and the like are commonly used for performing pressing operations on a running fibrous web in a paper or board machine. For instance, in the press section of a paper or board machine, the running web is dewatered by pressing the web in one or more shoe presses. Each of the shoe presses comprises a press shoe and a counter roll which between themselves form an extended nip through which the running web is carried by a circulated flexible belt. A plurality of loading cylinders are arranged between a supporting beam of the shoe press and the press shoe and adapted to press the press shoe against the counter roll.

The working chambers in the loading cylinders of some existing shoe presses are pressurized by hydraulic fluid via ducts bored in the frame system of the shoe press. For example, EP 345 501 B2, DE 195 15 832 C1, and DE 44 09 316 C1 each discloses a shoe press in which hydraulic fluid is supplied to the working chambers of the loading cylinders by ducts bored in the frame system. Boring the frame system, in most cases consisting of steel beams, in a shoe press for pressurizing by hydraulic fluid is a complicated and expensive procedure. Furthermore, the bores in the beam cause weakening of the beam, which can allow the beam to be deflected more easily. There is thus a need of simplifying and making the supply of hydraulic fluid to the working chambers of the loading cylinders less expensive, while obviating the other drawbacks mentioned above.

There is frequently also a desire to be able to vary the character of the pressure profile exerted on the running web in the nip of a shoe press, particularly in the machine direction along which the web travels. Accordingly, various mechanisms have been developed for shifting the position of a center of load exerted on a press shoe.

For example, various devices for moving the center of gravity of the supporting force acting on the press shoe relative to the press shoe are disclosed in U.S. Pat. No. 4,713,147, in which a press shoe support between the press shoe and the frame system of the shoe press is movable in the machine direction relative to the press shoe. In a variant, the press shoe support is a hydraulic-fluid-actuatable loading cylinder for pressing the press shoe against the counter roll. The press shoe support is engaged by a set screw journaled in a stationary frame of the shoe press. Rotation of the set screw causes the shoe support to be translated in the machine direction relative to the press shoe. The mechanism is relatively complicated.

SUMMARY OF THE INVENTION

The drawbacks noted above are overcome and other advantages are realized by the present invention, which provides a shoe press in which the working chambers of the loading cylinders are supplied with fluid from a common duct which is formed in an elongate duct member which is separate from the frame of the shoe press. By providing the common duct in a separate member, the duct can be manufactured in a particularly simple manner, for instance by extruding the duct member out of aluminum or the like. Extrusion of the duct member allows the manufacture of duct members in selected lengths for supplying any desired number of loading cylinders.

Thus, in accordance with one preferred embodiment of the invention, a shoe press comprises a press shoe having a first side adapted to coact with the counter roll to form an extended nip therebetween through which the running web is carried; a supporting frame spaced from a second side of the press shoe opposite the first side; a plurality of spaced-apart hydraulic loading cylinders disposed between the frame and the press shoe, each loading cylinder being formed of a piston and a tubular cylinder which slidably receives the piston, one of the piston and cylinder being a fixed member which is fixed relative to the frame and the other being movable, the piston and cylinder defining a working chamber therebetween which is pressurizable with hydraulic fluid; and an elongate duct member attached to the supporting frame and disposed contiguous to the fixed member of each of the loading cylinders, the duct member having a common duct formed therein which extends adjacent to each of the loading cylinders and a plurality of passages extending from the common duct to the loading cylinders, and each loading cylinder having a passage formed in the fixed member thereof which communicates with the corresponding passage in the elongate duct member. Thus, the working chambers of all of the loading cylinders are supplied with fluid from the common duct.

In one preferred embodiment of the invention, the piston of each loading cylinder is fixed relative to the frame and the cylinder is movable relative to the frame, and the passages which connect the common duct to each of the working chambers are formed through the piston of each loading cylinder.

Advantageously, the elongate duct member is affixed to a surface of the frame which faces the press shoe, and each of the pistons of the loading cylinders is affixed to the elongate duct member. Preferably, the pistons are supported on a surface of the elongate duct member which faces the press shoe.

The elongate duct member also allows simple, easily accessible and easily releasable connection of the loading cylinders to the horizontal beam. To this end, in one preferred embodiment the loading cylinders are affixed to the elongate duct member which in turn is releasably affixed to the frame. A pair of clamping members releasably clamp the duct member against the frame. Preferably, the duct member has opposite upstream and downstream sides and a groove formed in each of said sides, the clamping members engaging the grooves.

The elongate duct member and the loading cylinders thus comprise an easily moved unit which facilitates shifting the position of the loading cylinders relative to the frame and press shoe, for instance for varying the center of load acting on the press shoe so as to change the pressure profile exerted by the press shoe on the web running through the nip of the shoe press. To these ends, in one preferred embodiment the clamping members are eccentric and are fixable on the supporting frame in multiple positions for selectively placing different portions of the clamping members in engagement with grooves formed in the duct member so as to secure the elongate duct member and loading cylinders in various positions on the frame.

In one preferred embodiment, the clamping members comprise eccentric plates each fixed to the supporting frame by a threaded fastener, each of the plates being rotatable about the corresponding fastener for placing different portions of the plate in engagement with the respective groove in the duct member. Alternatively, the clamping members comprise elongate eccentrically flanged members oriented with a longitudinal axis of each of the flanged members extending in a cross-machine direction of the shoe press, the flanged members being rotatable about their longitudinal axes for placing different portions of the members in engagement with the grooves in the duct member.

BRIEF DESCRIPTION OF THE DRAWINGS

The above and other objects, features, and advantages of the invention will become more apparent from the following description of certain preferred embodiments thereof, when taken in conjunction with the accompanying drawings, in which.

DETAILED DESCRIPTION OF PREFERRED EMBODIMENTS

The invention is now explained by reference to certain preferred embodiments thereof. It is to be understood, however, that the present invention can be embodied in many different forms and should not be construed as being limited to the embodiments described herein; rather, these embodiments are presented so that this disclosure will be thorough and complete and will fully convey the scope of the invention to those skilled in the art. Like numbers refer to like elements throughout.

It is understood that the press shoe 1 is made in one piece, while the loading cylinders 6 which are several in number are distributed in the longitudinal direction of the press shoe (in the cross-direction) in one row or in several rows spaced from each other in the machine direction.

Figure 1:
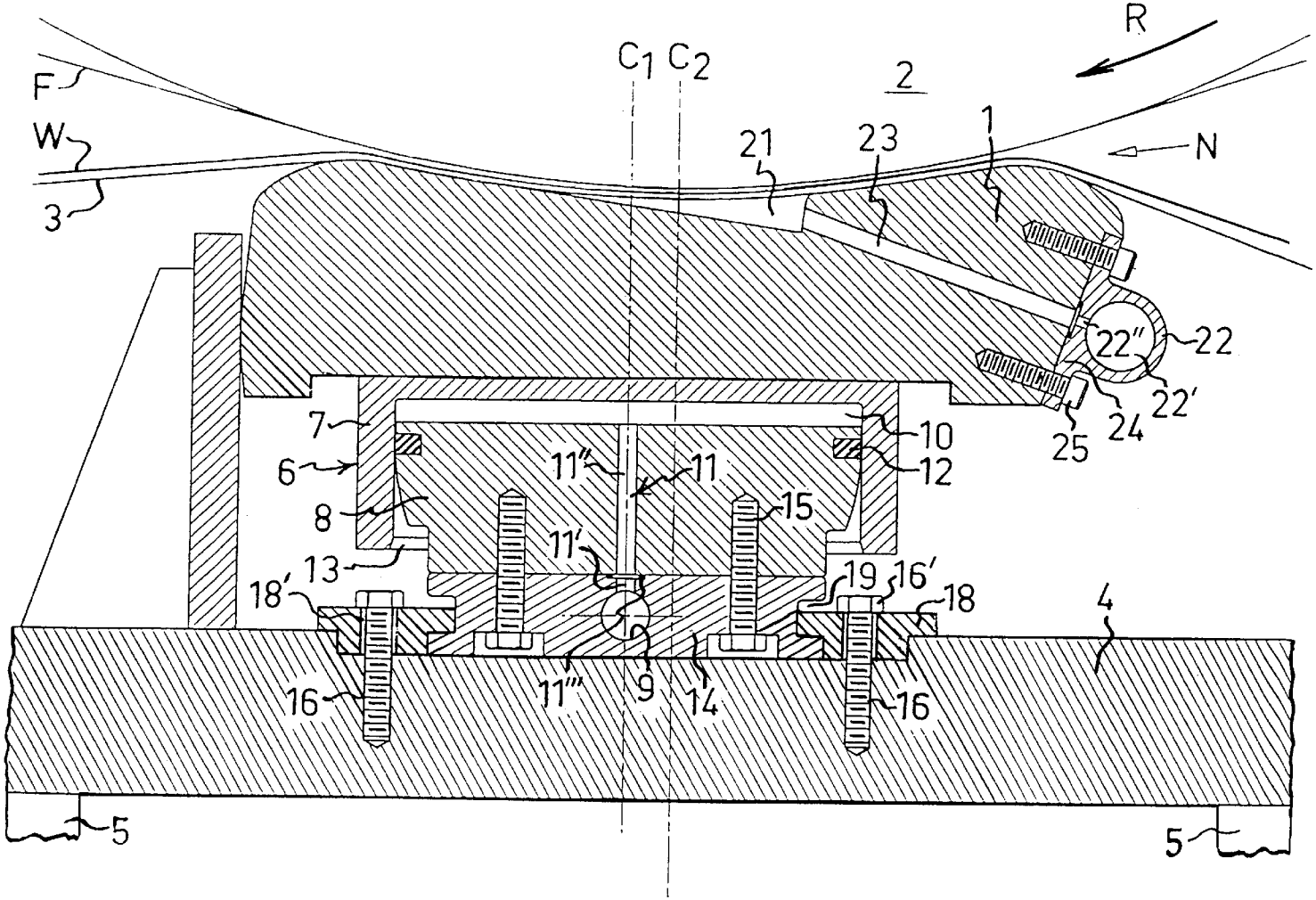
FIG. 1 is a cross-sectional view of a preferred embodiment of a shoe press in accordance with the invention viewed in a cross-machine direction of the shoe press.

FIG. 1 shows a shoe press for the press section of a paper or board machine. The shoe press includes a press shoe 1 and a counter roll 2 having the direction of rotation R, which between themselves form an extended nip N through which a paper or cardboard web W which is to be dewatered is carried together with a circulated flexible press belt 3 and one or two press felts F, of which one is shown. A horizontal beam 4 associated with the frame system 5 of the shoe press supports a plurality of loading cylinders 6 arranged in a row in the longitudinal direction of the press shoe. The loading cylinders are disposed between the beam 4 and the press shoe 1. Each of the loading cylinder 6 includes a cylinder 7 and a piston 8, the latter being fixed to the beam 4 in a manner that will be described in more detail below. An O-seal 12 seals between the piston 8 and the cylinder part 7. The press shoe 1 is loosely arranged on the loading cylinders 7 such that relative sliding motion can occur between the press shoe 1 and the loading cylinders 6. Each of the loading cylinders 6 can if desired have a hydrostatic compartment (not shown) in its surface facing the press shoe for floatingly supporting the press shoe.

A common duct 9 for supplying fluid to the working chambers 10 of the loading cylinders 6 is formed in a separate elongate duct member 14 which is releasably fixed on the beam 4 in a manner described below. Each of the pistons 8 of the loading cylinders is supported on the surface of the duct member 14 which faces the press shoe 1 and is affixed to the duct member 14. Thus, the duct member 14 forms part of all of the pistons 8 with screws 15 providing for connection of the pistons to the beam 4.

A vertical duct 11 (i.e., "vertical" generally referring to the loading direction from the beam 4 toward the counter roll 2 along which the force of the loading cylinder 6 acts) is formed in each piston 8 and connects the working chamber 10 to the common duct 9. Each of the vertical ducts 11 consists of two vertical duct parts 11' and 11", the duct part 11' being bored through the wall of the duct member 14 into the common duct 9 therein, and the duct part 11" being bored in the piston 8. In this manner, the vertical ducts 11' can be bored in advance in the duct member 14 and be sealed to be used later, if, for instance, further loading cylinders 6 are to be mounted, or can be bored only when additional loading cylinders are to be mounted.

Advantageously the duct member is made of aluminum alloy or the like which can be extruded to obtain the desired cross-section of the duct member 14 and the desired diameter of the common duct 9. When boring the vertical ducts 11', a space for an O-seal 11'" is formed in the end of these ducts 11'. The duct 9 is supplied with hydraulic fluid from a source (not shown) at one of its ends.

Figure 2:
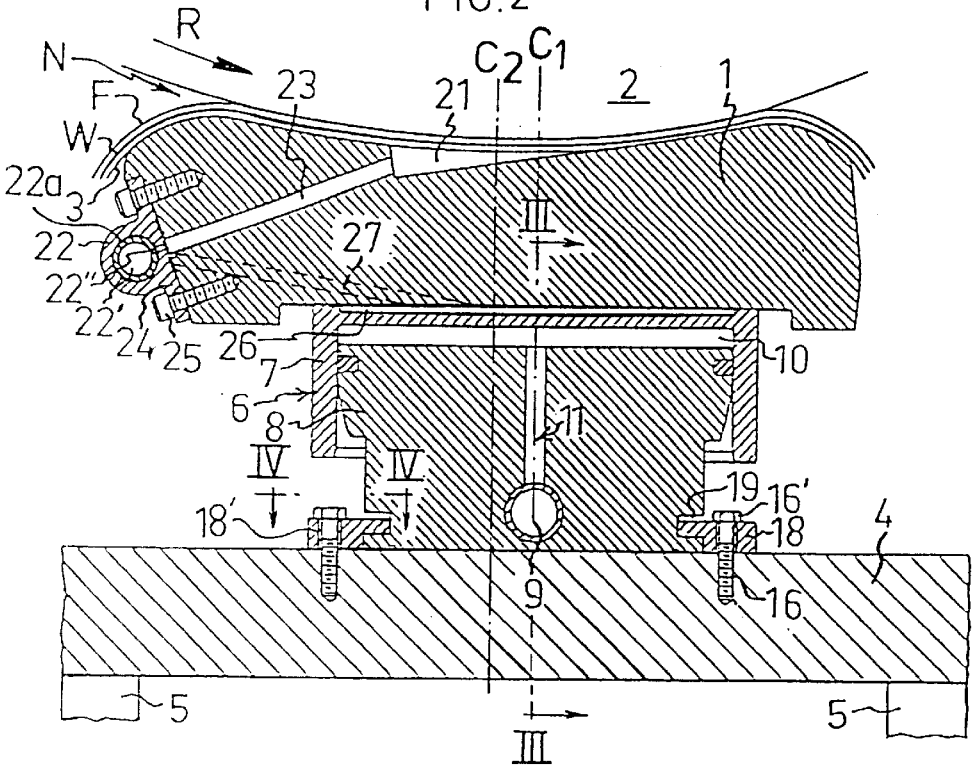
FIG. 2 is a cross-sectional view similar to FIG. 1, showing another preferred embodiment of a shoe press in accordance with the invention.
Figure 4:
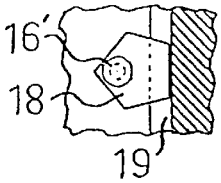
FIG. 4 is a top plan view of an eccentric plate, section IV—IV in FIG. 2.
Figure 3:
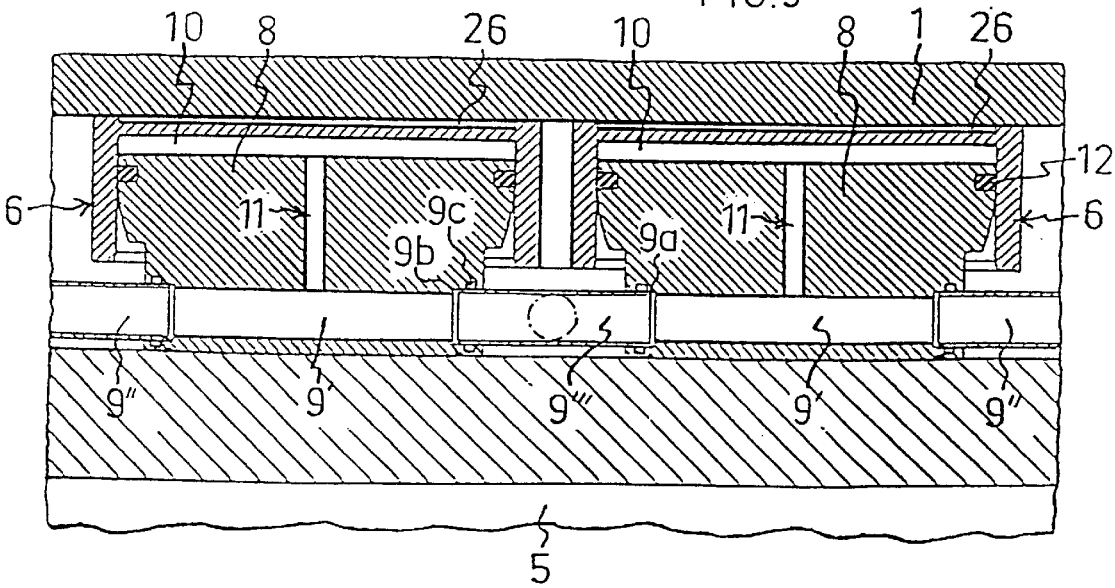
FIG. 3 is a cross-sectional view of the shoe press of FIG. 2 taken on the line II—II of FIG. 2.

A further possibility of commonly supplying a plurality of loading cylinders 6 is shown in FIGS. 2 and 3, which depict a shoe press with a plurality of loading cylinders 6 (two shown in FIG. 3) arranged in a row extending in the cross-machine direction. The common duct 9 is formed of bores 9' in the pistons 8 and of duct components 9" which extend between the loading cylinders 6 and mutually connect the bores 9'. The duct component 9'" is a T piece, whose leg, indicated by a dash-dot line, serves to connect the duct 9 to a hydraulic fluid source. The ends of the duct components 9" are simply inserted in the bores 9', which have widened ends **9*a* with an abutment 9*b* and an O-ring 9*c* for sealing. This embodiment allows in an advantageous manner connection of the hydraulic fluid source in the duct 9 between two optional neighboring loading cylinders 6** and also allows in an advantageous manner absorption of forces caused by heat deformation.

The securing of the pistons 8 on the beam 4 is preferably carried out in such a manner that the loading cylinders 6 can, if desired, be moved relative to the press shoe 1 in the machine direction, for moving the center lines C1 of the loading cylinders 6 relative to the center line C2 of the shoe press. Such movement of the shoe can be desirable, for example, for altering the pressure profile exerted by the press shoe 1 on the web W in the extended nip N.

The securing device consists, in the illustrated embodiments, of a suitable number of fasteners such as screws 16, and a corresponding number of eccentric clamping members such as the illustrated screw plates 18 on opposite upstream and downstream sides of each piston 8. In the shoe press of FIG. 1, the upstream and downstream sides of the elongate duct member 14 each has a groove 19 formed therein and the plates 18 engage the grooves in the duct member 14. In the embodiment shown in FIG. 2 and 3, each of the upstream and downstream sides of each piston 8 has a groove 19 formed therein and the plates 18 engage the grooves 19 in the pistons 8. Each of the plates 18 has a hole 18' through which the screws 16 pass, and the screws are screwed in the beam 4. Thus, tightening the screws at the screw heads 16' causes the latter to clamp the plates 18 between themselves and the beam 4, thereby fixedly securing the duct member 14, or alternatively the pistons 8, on the beam 4.

The plates 18 are polygonal in the same way and, as shown, are eccentric. The center line C1 of the loading cylinders 6 can thus be moved relative to the center line C2 of the shoe press, if desired, by loosening the screws 16 at their heads 16' and rotating the plates around the screws 16 for permitting the desired displacement of the loading cylinder 6 in the desired direction of movement (i.e., the machine direction). If the loading cylinder 6 in FIG. 1 is, for instance, to be moved in the direction of travel of the web W, the right plate 18 is rotated such that an edge thereof positioned farther away from the center axis of the screw 16 engages in the right groove 19, and the left plate 18 is rotated such that an edge thereof positioned correspondingly closer to the center axis of the screw 16 engages in the left groove 19.

Alternatively to eccentric plates, for instance, a single eccentrically flanged sectional rod or bar can be arranged on the respective sides of the loading cylinders engaging in the grooves 19 of the duct member 14 or the pistons 8 by means of a flange and screwed in the beam 4 by means of another flange. For example, the members 18 in FIG. 1 can be regarded as elongate members having the cross-sectional shape shown in FIG. 1 and extending across a plurality of the loading cylinders. Thus, the desired movement of the loading cylinders is accomplishable by loosening the screws, and then rotating the members 18 about their longitudinal axes so that the other flange portion of each member 18 engages the respective groove 19. Various other types of eccentric members can be used.

While the invention has been described with reference to a shoe press for use in a press section of a papermaking machine, it will be understood that the invention is also applicable to a calender section of a papermaking machine.

Many modifications and other embodiments of the invention will come to mind to one skilled in the art to which this invention pertains having the benefit of the teachings presented in the foregoing description and accompanying drawings. Therefore, it is to be understood that the invention is not to be limited to the particular embodiments illustrated and described herein, and that modifications, substitutions of equivalents, and other embodiments are intended to be included within the scope of the appended claims. For example, while the described embodiments have the pistons of the loading cylinders fixed relative to the frame and the cylinder members movable relative to the frame, it will be recognized by those skilled in the art that this arrangement can be reversed such that the cylinder members are fixed to the frame and the pistons are movable. In this case, the common duct of the elongate duct member connects to the working chambers via passages formed through the cylinder members rather than through the pistons. Other modifications are also possible within the scope of the invention. Although specific terms are employed herein, they are used in a generic and descriptive sense only and not for purposes of limitation.

That which is claimed is:

1. A shoe press for pressing a running fibrous web against a counter roll, comprising:

a press shoe having a first side adapted to coact with the counter roll to form an extended nip therebetween through which the running web is carried;

a supporting frame spaced from a second side of the press shoe opposite the first side;

a plurality of spaced-apart hydraulic loading cylinders disposed between the frame and the press shoe, each loading cylinder being formed of a piston and a tubular cylinder which slidably receives the piston, one of the piston and cylinder being a fixed member which is fixed relative to the frame and the other being movable, the piston and cylinder defining a working chamber therebetween which is pressurizable with hydraulic fluid; and an elongate duct member attached to the supporting frame and disposed contiguous to the fixed member of each of the loading cylinders, the duct member having a common duct formed therein which extends adjacent to each of the loading cylinders and a plurality of passages extending from the common duct to the loading cylinders, and each loading cylinder having a passage formed in the fixed member thereof which communicates with the corresponding passage in the elongate duct member, whereby the working chambers of the plurality of loading cylinders are all supplied with fluid from the common duct.

2. The shoe press of claim 1, wherein the piston of each loading cylinder is fixed relative to the frame and the cylinder is movable relative to the frame, the passages which connect the common duct to each of the working chambers being formed through the piston of each loading cylinder.

3. The shoe press of claim 2, wherein the elongate duct member is affixed to a surface of the frame which faces the press shoe, and each of the pistons of the loading cylinders is affixed to the elongate duct member.

4. The shoe press of claim 3, wherein the pistons are supported on a surface of the elongate duct member which faces the press shoe.

5. The shoe press of claim 3, wherein the elongate duct member is releasably affixed to the frame.

6. The shoe press of claim 5, further comprising a pair of clamping members which releasably clamp the duct member against the frame.

7. The shoe press of claim 6, wherein the duct member has opposite upstream and downstream sides and a groove formed in each of said sides, the clamping members engaging the grooves.

8. The shoe press of claim 7, wherein the clamping members are eccentric and are fixable on the supporting frame in multiple positions for selectively placing different portions of the clamping members in engagement with the grooves so as to secure the elongate duct and loading cylinders in various positions on the frame.

9. The shoe press of claim 8, wherein the clamping members comprise eccentric plates each fixed to the supporting frame by a threaded fastener, each of the plates being rotatable about the corresponding fastener for placing different portions of the plate in engagement with the respective groove in the duct member.

10. The shoe press of claim 8, wherein the clamping members comprise elongate eccentrically flanged members oriented with a longitudinal axis of each of the flanged members extending in a cross-machine direction of the shoe press, the flanged members being rotatable about their longitudinal axes for placing different portions of the members in engagement with the grooves in the duct member.

* * * * *